US005582026A

United States Patent [19]

Barto, Sr.

[11] Patent Number: 5,582,026

[45] Date of Patent: Dec. 10, 1996

[54] AIR CONDITIONING SYSTEM

[76] Inventor: Stephen W. Barto, Sr., 39 Tortuga Rd., Palm Springs, Fla. 33461

[21] Appl. No.: 232,614

[22] Filed: Apr. 25, 1994

Related U.S. Application Data

[63] Continuation-in-part of Ser. No. 909,990, Jul. 7, 1992, abandoned.

[51] Int. Cl.[6] ..... F25D 19/00; F25B 27/00

[52] U.S. Cl. ..... 62/298; 62/302; 62/326

[58] Field of Search ..... 62/297, 298, 302, 62/DIG. 16, 499, 77, 259.1, 267, 326

[56] References Cited

U.S. PATENT DOCUMENTS

| | | | |
|---|---|---|---|
| 1,649,733 | 11/1927 | Richmond | 62/302 |
| 2,265,272 | 12/1941 | Ditzler | 62/298 |
| 2,268,451 | 12/1941 | Hull | 62/326 |
| 2,644,321 | 7/1953 | Borgerd | 62/326 |
| 2,779,572 | 1/1957 | Holman | 257/9 |
| 2,948,498 | 8/1960 | Johnsen et al. | 62/302 |
| 2,994,211 | 8/1961 | Lehmkuhl et al. | 62/262 |
| 3,411,569 | 11/1968 | Hildreth | 62/302 |
| 3,611,743 | 10/1971 | Manganaro | 62/263 |
| 3,665,727 | 5/1972 | Mather | 62/262 |
| 3,742,659 | 7/1973 | Drew | 52/19 |
| 3,884,048 | 5/1975 | Schneider | 62/298 |
| 4,016,729 | 4/1977 | Cherry | 62/259 |
| 4,139,052 | 2/1979 | Lackey | 165/59 |
| 4,483,155 | 11/1984 | Stiles | 62/259.1 |
| 5,142,883 | 9/1992 | DeWitt | 62/298 |

OTHER PUBLICATIONS

Gafers & Sattler, "Roof Jack Models: RJ 18/24/1 & RJ 30–1".

Gaffers & Sattler, Inc. Los Angeles, CA May 1976.

Janitrol, "9+ Seer Package Air Conditioner 2 Thru 5 Ton/ Replacement for G & S Units" Goodman Mfg. Corp. Houston, TX Jul. 1988.

Intertherm, "ASC Series Self–Contained Air Conditioner" Arco Supply, Inc., FL.

"Ruud Self–Contained Air Conditioners", Ruud A/C Division, Fort Smith, Ark.

"Achiever 12 Super Hi–Efficiency Condensing Units", Ruud A/C Division, Fort Smith, Ark.

*Primary Examiner*—Henry A. Bennet
*Assistant Examiner*—William C. Doerrler
*Attorney, Agent, or Firm*—Quarles & Brady

[57] ABSTRACT

An air conditioning system has an air handling unit within a housing. The air handling unit is adapted for connection to the supply and return air ducts of a building and for mounting at the roof of the building. A separate and distinct condensing unit can be mounted above, adjacent to, or removed from the air handling unit such that the air handling unit can be installed in relatively small roof spaces, while the condensing unit can be installed in locations where sufficient space exists. Fluid connection structure extends between the condensing unit and the air handling unit. The system is easily serviceable, and pullout sections within this system improve maintenance procedures. The invention has utility as an original installation unit, and has further utility as a replacement unit for small dimension air conditioning unit or units in small roof spaces.

8 Claims, 20 Drawing Sheets

AIR CONDITIONING SYSTEM

This application is a continuation-in-part of Applicant's application Ser. No. 909,990, filed Jul. 7, 1992, now abandoned.

BACKGROUND OF THE INVENTION

Field of the Invention

This invention relates generally to air handling and air conditioning apparatus, and more particularly to air conditioning apparatus having improved installation and replacement versatility, energy efficiency, and maintenance features as compared to conventional rooftop package air conditioning equipment.

Description of the Relevant Art

Air conditioning units have been sold as single package units including a condensing section and a air handling section, or as split system units in which an air handling unit is installed within the building and a condensing unit is installed outside of the building. The single package unitary unit is installed on the roof of the building and reduces the amount of noise that is transmitted through the building. The air handling and condensing sections are both contained within a single housing, which reduces labor and material costs during the installation process. The equipment is completely housed on the roof of the building, where it is usually easy to access and to service.

Single package units have a number of disadvantages. The condensing section and the air handling section are together within the same housing, and compressor noise is sometimes transmitted into the building through the adjacent air ducts. The entire package unit must be replaced if the condensing or air handling section cannot be repaired, increasing maintenance costs. Further, rusting of the connection of the cabinet between the condensing section and the air handling section usually causes water damage to the air handling section and sometimes water leaks within the building. Also, the efficiency of package equipment is typically reduced since an effort must be made to keep the total package as small as possible. Single package equipment frequently has condensate drain problems due to a small drain pan and lines. The unit must be installed level or water can back up and cause damage to the interior of the building. Relevelling the unit requires relevelling the curb, which requires cutting and restoring the roof.

Single package unit equipment typically matches compressors to evaporators in factory-provided sizes, which limits the versatility of a unit for particular installations. Also, the matched combination requires an extensive inventory in order to satisfy customer needs. Many manufacturers carry at least three (3) different Seasonal Energy Efficiency Rating (SEER) selections. Residential and light commercial air conditioning equipment is usually offered in seven (7) capacities of 1.5, 2.0, 2.5, 3.0, 3.5, 4.0 and 5.0 nominal tons. These selections are offered as either a standard air conditioning unit with optional electric heating, or as a reverse cycle heat pump unit. Four duct configurations are commonly used. This variety of offerings creates 168 (3×7×2×4) different units which the supplier must have on hand or be prepared to manufacture on request. This calculation does not even account for the differences between downflow units and horizontal flow units. These selections require manufacturers to have large manufacturing and warehousing facilities, which increases the cost to consumers. Design changes require large scale changes in manufacturing, and can render a large amount of inventory obsolete of reduced value.

Another disadvantage of unitary rooftop package units is that the condensing unit is located on the roof, where temperatures can reach one hundred thirty (130) degrees Fahrenheit. The efficiency and capacity of the entire unit is affected by the location of the condensing unit, which cannot be changed because of the need for placement next to the existing ducts.

The split system air conditioning unit allows the independent replacement of either the condensing unit or the air handling unit in the event that repair is not possible. The air handling unit is installed within the building or an equipment room, which reduces the deterioration of this unit from outdoor elements. The split system unit is more versatile than the single package unit for specific air conditioning problems, since the air handling unit and the condensing unit can be provided separately. The many different SEER and capacity offerings still require forty two (42) different condensing units and four (4) different air handling unit cabinets with forty two (42) different evaporator coil configurations.

The provision of the air handling unit within the building in a split system air conditioning installation is noisy unless particular effort is made to reduce equipment noise. Auxiliary drain pans must be used to prevent overflow of condensate from the air handling unit from leaking directly into the building. The air handling unit takes up floor space, ceiling space, or attic space, which typically can be utilized for other purposes. Service in some building installations, such as in the attic, is often difficult. Extra labor and materials are required to install the air handling unit within the building, and to separately install the condensing unit outside of the building.

Replacement of a unitary rooftop package unit is frequently complicated by the unavailability of a unit which corresponds to the existing roof curb. A new roof curb must be installed, which requires roof work and resealing of the ducts. This can result in twice the expense of a replacement that matches the existing curb. An example of such a discontinued rooftop package is a unit formerly manufactured by Gaffers & Sattler, Inc. of Los Angeles, Calif. This unit was widely used in limited roof space installations because the condensing section was located in a single package unit directly on top of the air handling section, and required under six (6) sq. ft. of roof space for an installation. Currently available equipment of similar air conditioning capacity but a more desirable SEER requires significantly more roof space, often twelve (12) sq. ft. or more, and accordingly, replacement of an unrepairable Gaffers & Sattler unit can require extensive and expensive modifications to the air conditioning installation.

Some buildings have a supply air fan to introduce outside air into the building. The air is sometimes drawn through a series of filters, but is not used for cooling. This air is sometimes heated before introduction into the building if the outside ambient air temperature is below tolerable levels. A supply air fan can also be used to circulate air within the building for purposes of filtering the air, or to also heat the air. Supply air fans are typically distinct from air handling units, the latter having integral evaporator coils.

SUMMARY OF THE INVENTION

It is an object of the invention to provide an air conditioning apparatus for rooftop applications that has utility as an original installation or as a replacement for existing unitary rooftop package units, outside air makeup fans or recirculating filter fans, without modification to the existing air conditioning or ventilation system or roof structure.

It is another object of the invention to provide an air conditioning apparatus that will reduce at least one of manufacturing tooling cost, manufacturing design cost, facility inventory cost, replacement cost, and the cost of design changes.

It is an object of the invention to provide air conditioning apparatus capable of installation in small roof spaces.

It is another object of the invention to provide air conditioning apparatus which have acceptable energy efficiency ratings.

It is yet another object of the invention to provide air conditioning apparatus which can be installed with relatively low-man-hours.

It is another object of the invention to provide an air conditioning system which can be adapted to many different air conditioning requirements.

It is still another object of the invention to provide an air conditioning system which is readily serviceable.

It is another object of the invention to provide an air conditioning system which is durable.

These and other objects are accomplished by an air conditioning system having an air handling unit comprised principally of an evaporator coil and evaporator fan assemblies within a housing. A condensing unit within a separate housing is also provided. The air handling unit and housing are separate and distinct from the condensing unit and housing. Fluid connection structure provides for the flow of refrigerant between the air handling unit and the condensing unit.

The air handling unit is mounted at the roof of the building, and is connected to the supply/return air ducts. A unitary base roof jack can be provided to make a water tight connection between the air handling unit, the roof, and the supply/return air ducts.

The condensing unit can be located adjacent to the air handling unit, preferably on a connecting skid, or in a more remote location wherever space or other characteristics of the installation permit or require. In one embodiment, the condensing unit can rest on top of the air handling unit such that a minimum of roof space is required for the total installation. This configuration is particularly useful for the replacement of small dimension air conditioners, particularly those formerly manufactured by Gaffers & Sattler, Inc. of Los Angeles, Calif.

The air handling unit and housing can be mounted to the roof and to the supply/return air ducts according to a variety of different designs. A roof jack according to the invention can be provided for attachment over the roof curb. The roof jack includes an upstanding flange over which a portion of the air handling unit housing can rest, so as to substantially preclude the possibility of leakage into the building. Other roof jack constructions could alternatively be utilized.

The invention also provides versatility in equipment selection, as the condensing unit can be selected from several commercially available units. An air handling unit according to the invention would be matched to a condensing unit according to the air conditioning characteristics of the installation or replacement assignment. The SEER of the air handling unit can be offered in the highest available rating, if desired, since the extra expense is usually minor. This will prevent the need for maintaining a large inventory of single package units of varying capacity and SEER, and the installer need only buy a condensing unit of acceptable SEER.

The invention is easily serviced, as either the air handling unit or the condensing unit can be totally replaced if necessary without the additional expense of replacing the entire air conditioning system. The air handling unit and condensing unit are located totally on the roof, in outside spaces, or in an exterior equipment room, so as to reduce interior installation costs, service difficulties, interior compressor noise, and the likelihood of water damage.

The serviceability of the invention is enhanced by the provision of pull-out component portions for ready access by the service technician. The evaporator coil deck, fan assembly deck, control panel and electric heater are provided on these slide-out modules. The modules are accessible through at least two access openings.

The invention provides an air conditioning system which is easily installed in almost any roof-top location. Should roof fixtures reduce the amount of space available for the unit, the air handling unit alone can be mounted at the roof opening and the condensing unit can be mounted where more space is available, or in a more convenient location. Also, the pull-out modules can be reversed for making appropriate connections to refrigerant lines or electrical outlets.

The invention can be used as an outside air makeup fan and a recirculating filtering fan. The filters, preferably high efficiency filters, can be installed in place of the evaporator coil. Outside air can be introduced by installing an outside air hood. Heating can be accomplished by an electric heating device to heat the air, if necessary. Currently available equipment has an Energy Efficiency Rating (EER) of below about 10 EER, while the invention can provide between about 10–12 EER with a properly selected condensing unit.

BRIEF DESCRIPTION OF THE DRAWINGS

There are shown in the drawings embodiments which are presently preferred. It should be understood, however, that the invention is not limited to these embodiments, wherein.

DETAILED DESCRIPTION OF THE PREFERRED EMBODIMENTS

Figure 1:
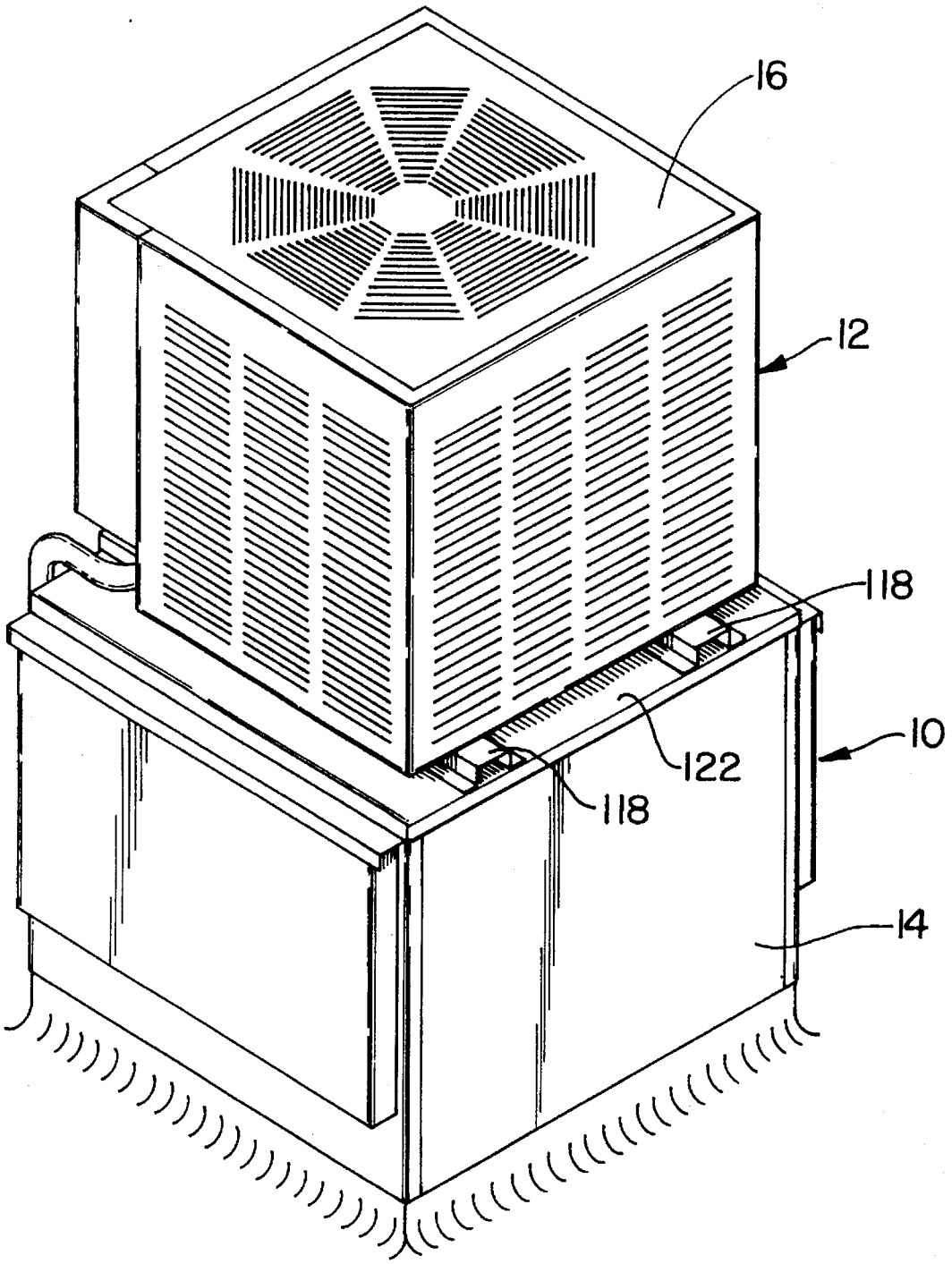
FIG. 1 is a perspective view of a downflow air handling unit according to the invention with a separate condensing unit.

Referring to the drawings, there is shown an air conditioning system comprised principally of an air handling unit 10 and a condensing unit 12. The air handling unit 10 is contained within a housing 14. Access into the housing 14 to service the components of the air handling unit 10 is preferably provided by water tight access panels 15. The condensing unit 12 is contained within a separate housing 16. Fluid connection structure between the air handling unit 10 and the condensing unit 12 provide for the flow of refrigerant between the air handling unit 10 and the condensing unit 12. The air handling unit 10 is mounted at the roof of the building, where it is joined to the supply/return air ducts. The condensing unit can be mounted adjacent to the air handling unit, or in a remote location where space is available or where mounting is otherwise desirable.

The air handling unit 10 is comprised of conventional air handling system components such as the evaporator coil 20 and the evaporator fan 24. Refrigerant is supplied through a liquid supply line 28, and is returned to the condensing unit through a suction line 32, in the cooling cycle, which can have a suction flange 34. In a reverse cycle heat pump air conditioning system, the refrigerant in the heating cycle is supplied through the suction line 32, and is returned to the condensing unit 12 through the liquid line 28. A liquid line reversible drier 30 can also be provided, as can a liquid flange or removable fitting 31 at the drier 30. An expansion valve sensing bulb 38 can be provided at the suction line 32. Liquid refrigerant in the liquid supply line 28 is passed to an expansion valve 42, and then through a distributor and capillary feed lines 46 and the evaporator coil 20.

An electrical control box 50 can be provided for the electrical controls and connections. The electrical control box 50 can be mounted through mounting flanges 52 or other suitable structure. The electrical control box 50 can have the transformer, evaporator fan relays, low voltage bar for connection to the thermostat, heat relays, and other electrical devices and connections necessary for operation of the air conditioning system.

Figure 5:
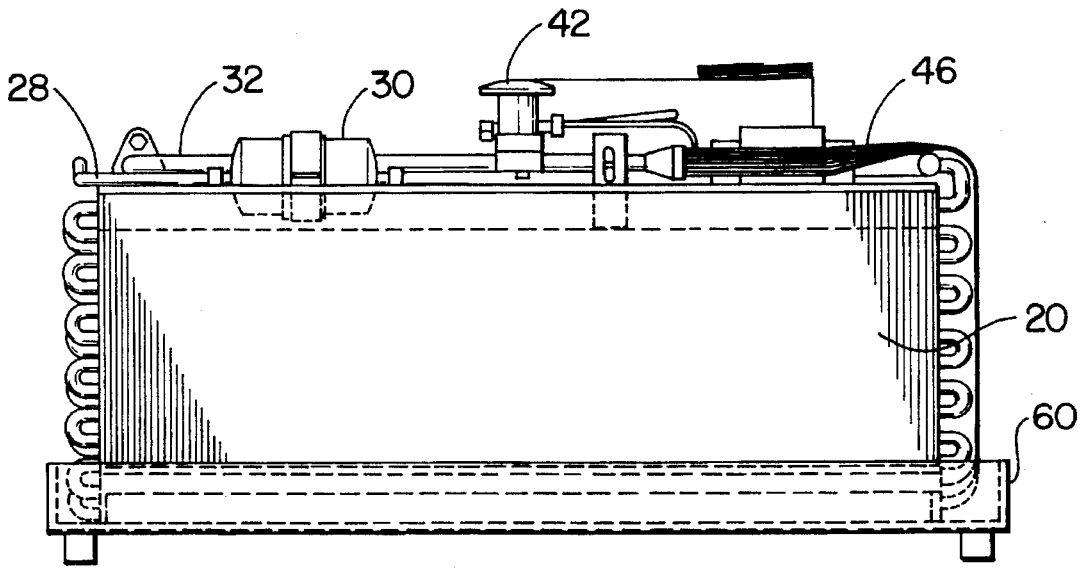
FIG. 5 is a side elevation, partially in phantom, of an evaporator coil and deck assembly according to the invention.
Figure 6:
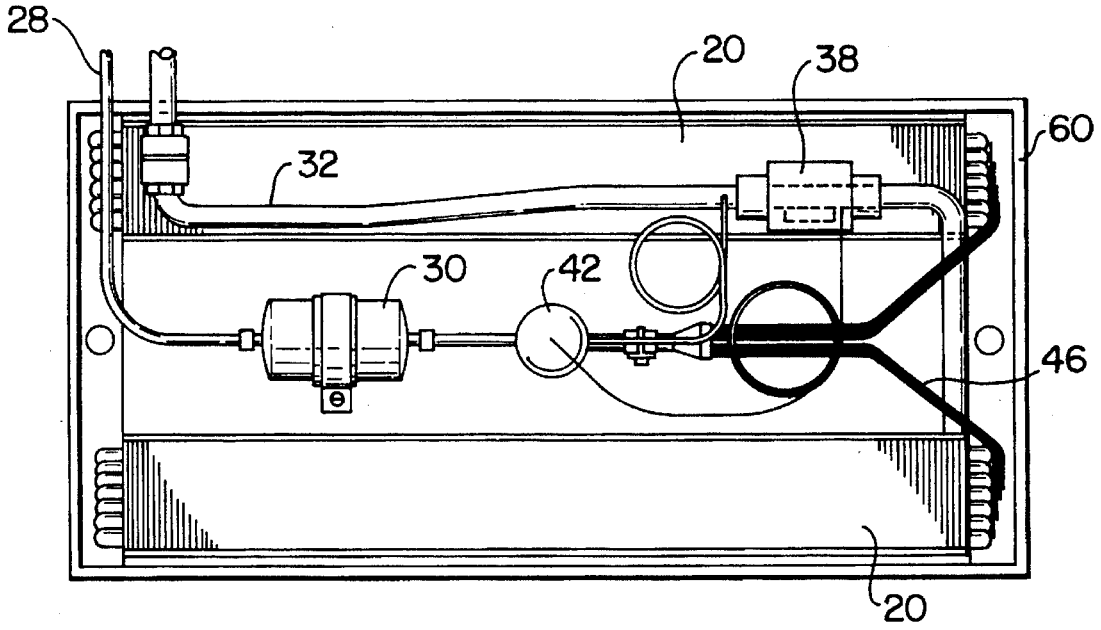
FIG. 6 is a top plan view, partially in phantom and partially broken away.

The air handling unit according to the invention preferably includes structure to facilitate the servicing of the unit. In one embodiment, the evaporator coil 20 and related components are provided on an evaporator coil assembly deck 60 (FIGS. 4–6) which can be moved from within the housing 14. The evaporator coil deck 60 is preferably slidably mounted on suitable supports 62 within the housing 14, such that the evaporator coil deck 60 can be easily removed from the housing 14 for servicing of the components thereof. The evaporator coil deck 60 can be comprised of raised side flanges 64 such that the deck 60 will function as a drain pan for the evaporator coil 20. A condensate exit conduit 68 can be connected to the evaporator deck 60 by suitable structure such as a flexible hose connection 70 and clamps 72. The condensate exit conduit 68 can thereby be easily disconnected from the evaporator coil deck 60. A condensate exit conduit drain opening 69 is preferably located at either end of the evaporator coil deck/drain pan 60 to allow for constant condensate drainage which is not restricted by the positioning of the evaporator coil assembly deck 60, since water can drain through either end of the pan. The openings 69 are connected by feed lines to the condensate exit conduit 68.

The evaporator coil deck 60 with the evaporator coil 20 can be reversed in orientation in the air handling unit housing 14, depending on the installation location of the air handling unit 10, to aid in the access to and servicing of the components. Left or right handed fittings can be provided for appropriate connection to liquid supply line 28 and suction line 32.

Figure 2:
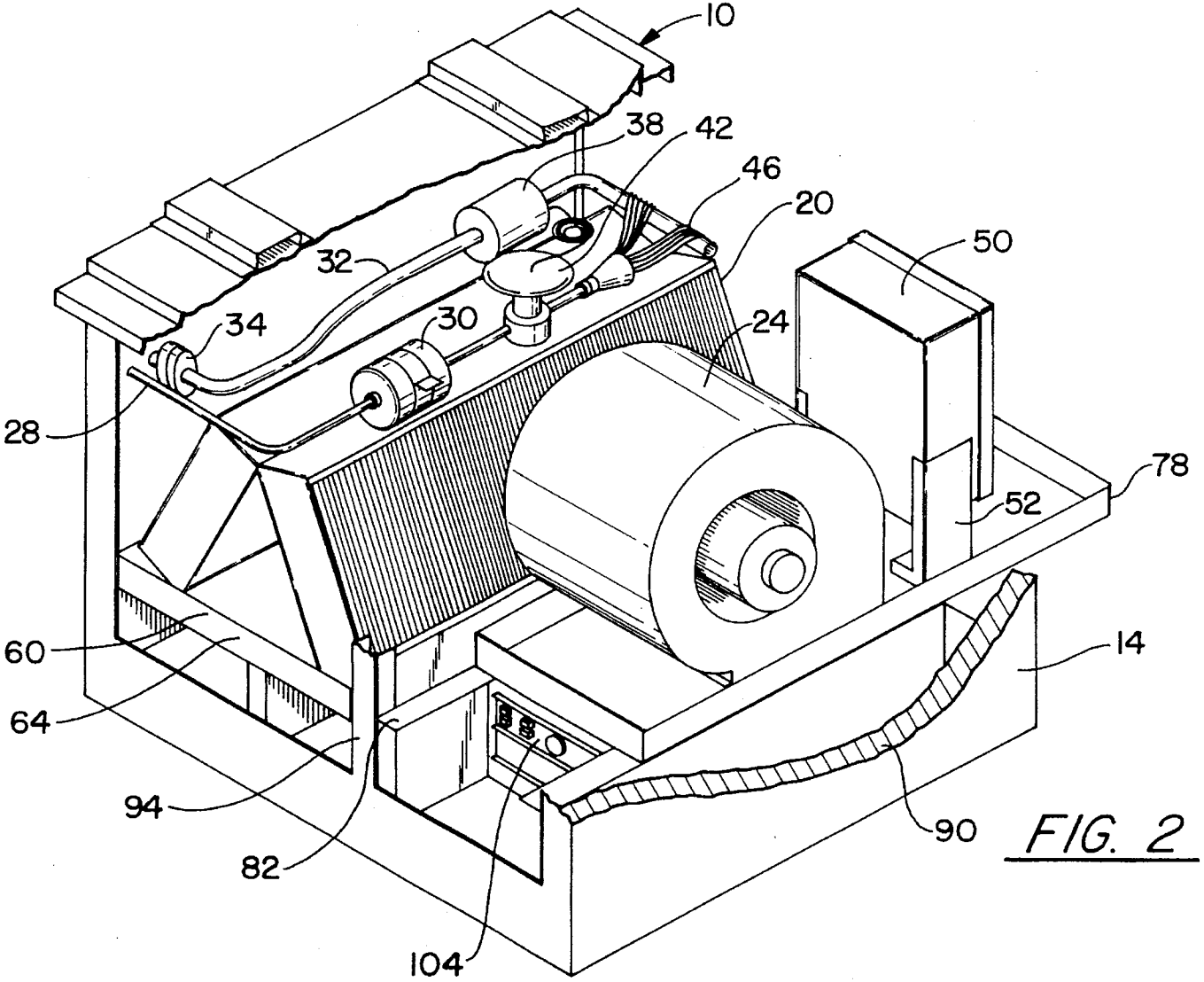
FIG. 2 is a perspective view, partially broken away, of an air handling unit according to the invention.
Figure 3:
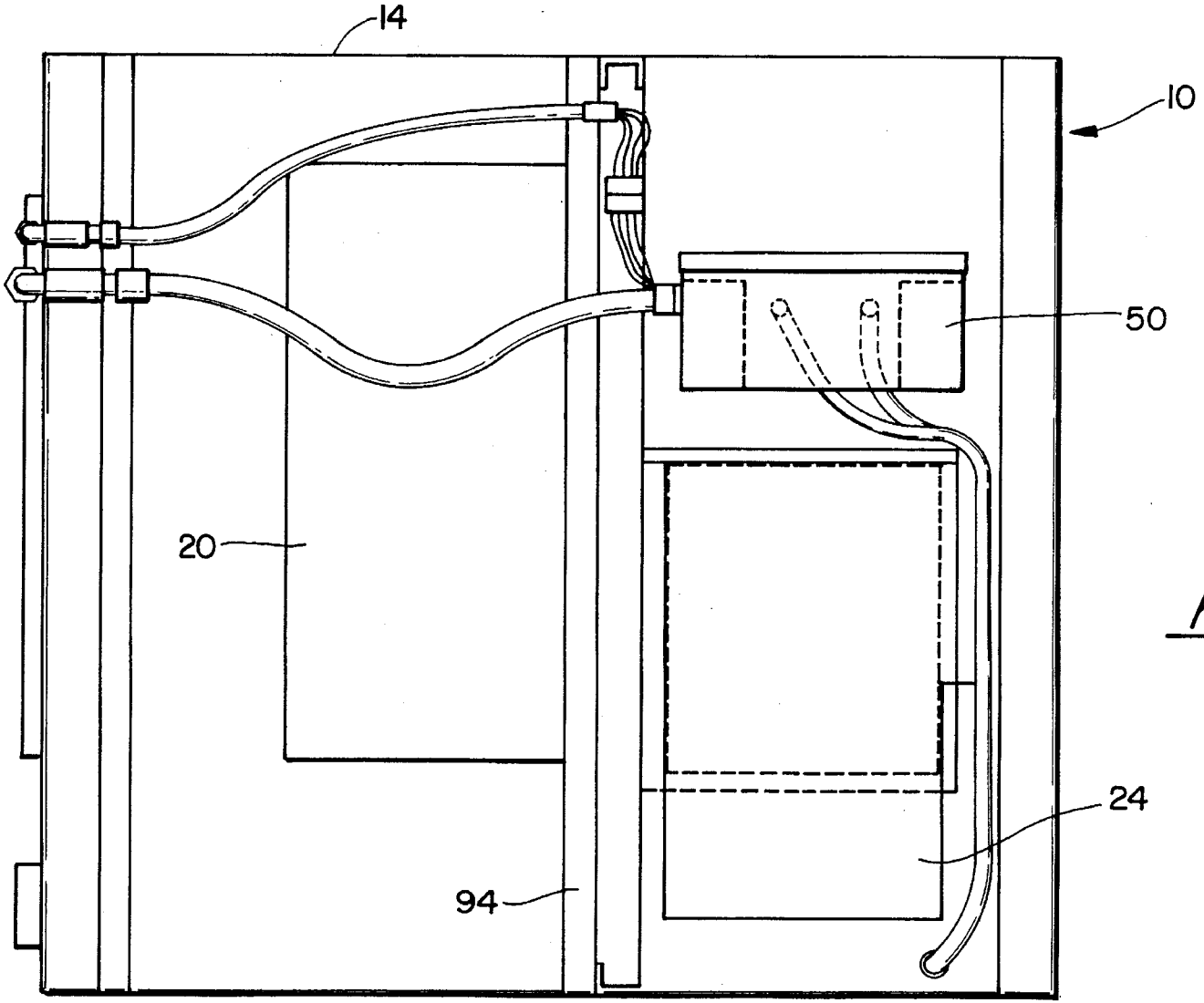
FIG. 3 is a top plan view, partially broken away and partially in phantom.
Figure 4:
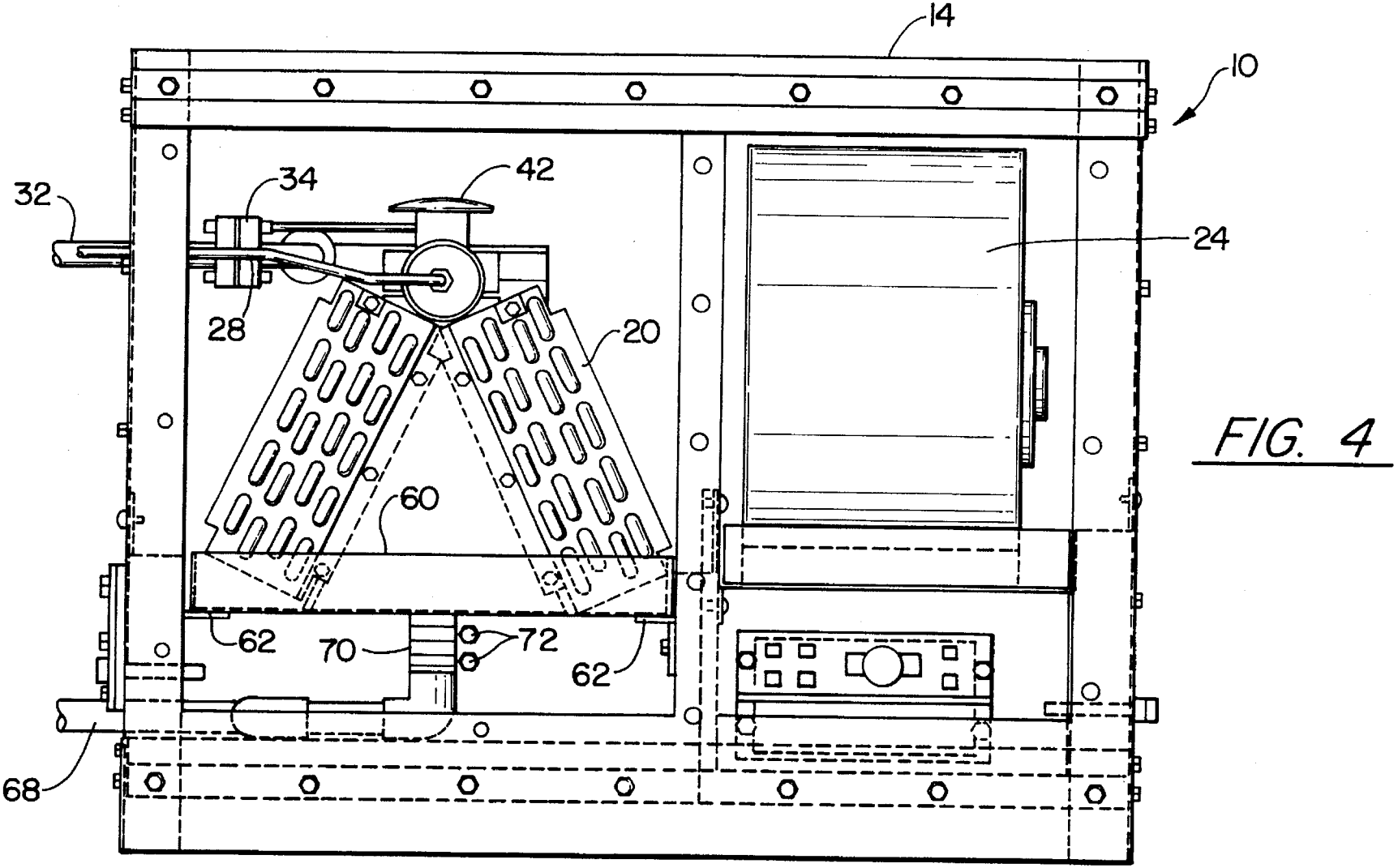
FIG. 4 is a side elevation, partially broken away and partially in phantom.
Figure 7:
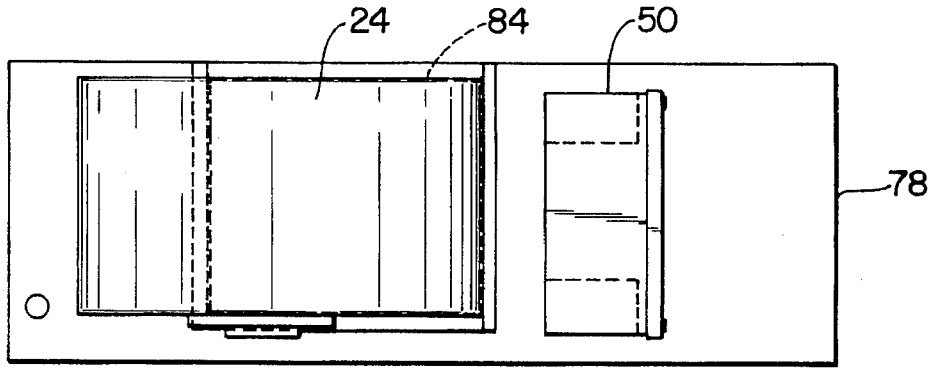
FIG. 7 is a top plan view, partially in phantom, of an evaporator fan assembly and deck according to the invention.
Figure 8:
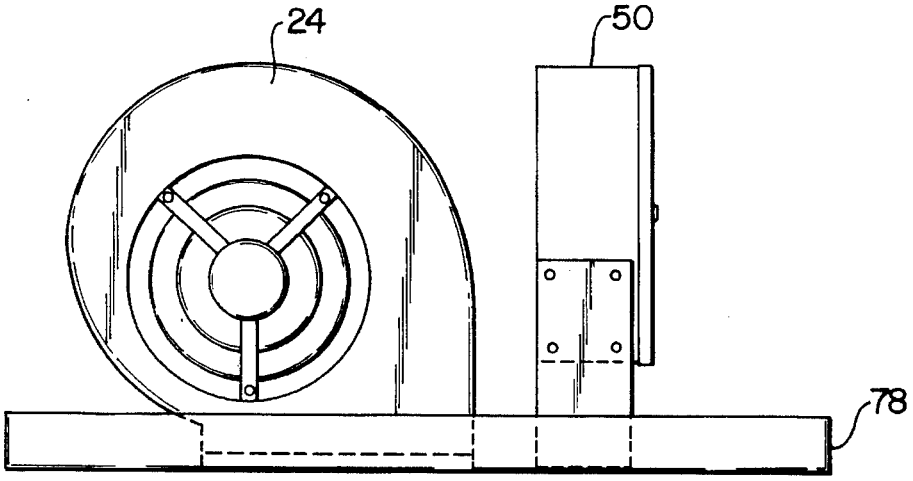
FIG. 8 is a side elevation, partially in phantom.
Figure 9:
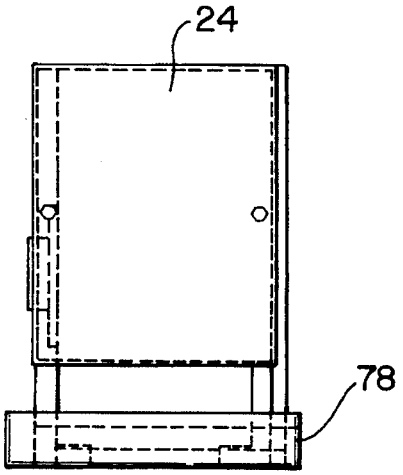
FIG. 9 is a front elevation, partially in phantom.
Figure 10:
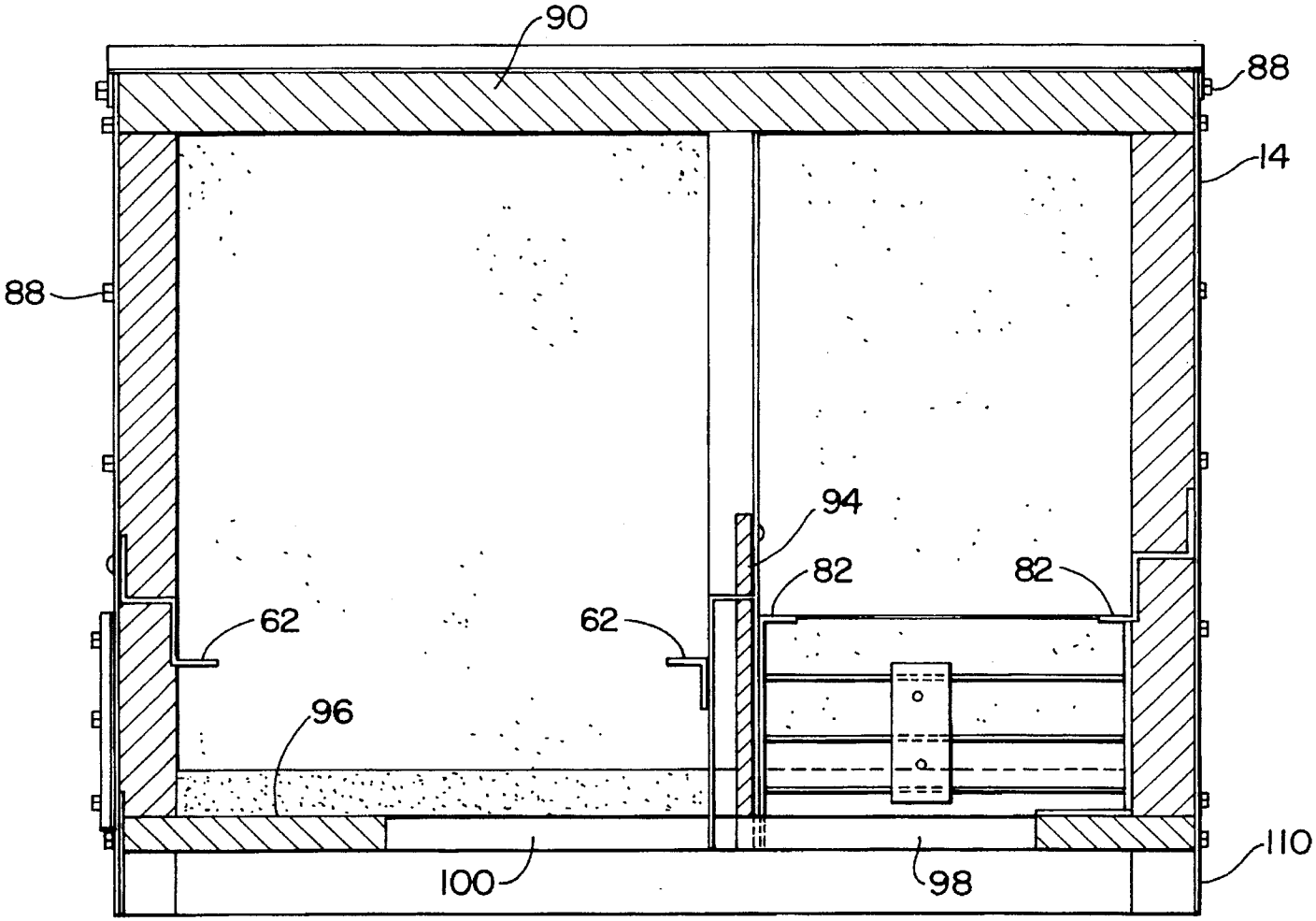
FIG. 10 is a cross section, partially in phantom, of an air handling unit housing according to the invention.
Figure 11:
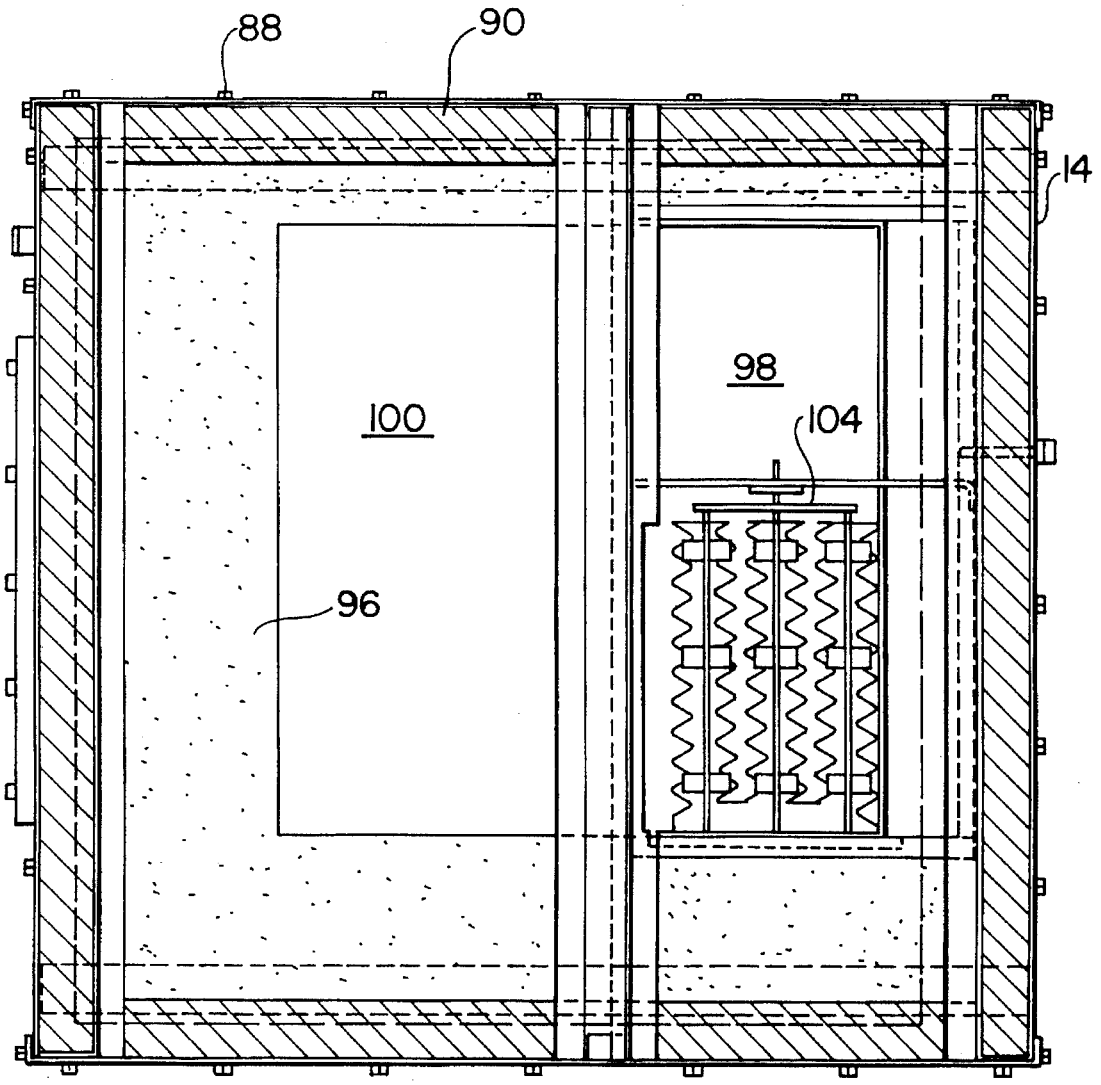
FIG. 11 is a cross section, partially broken away and partially in phantom, of an air handling unit according to the invention.
Figure 12:
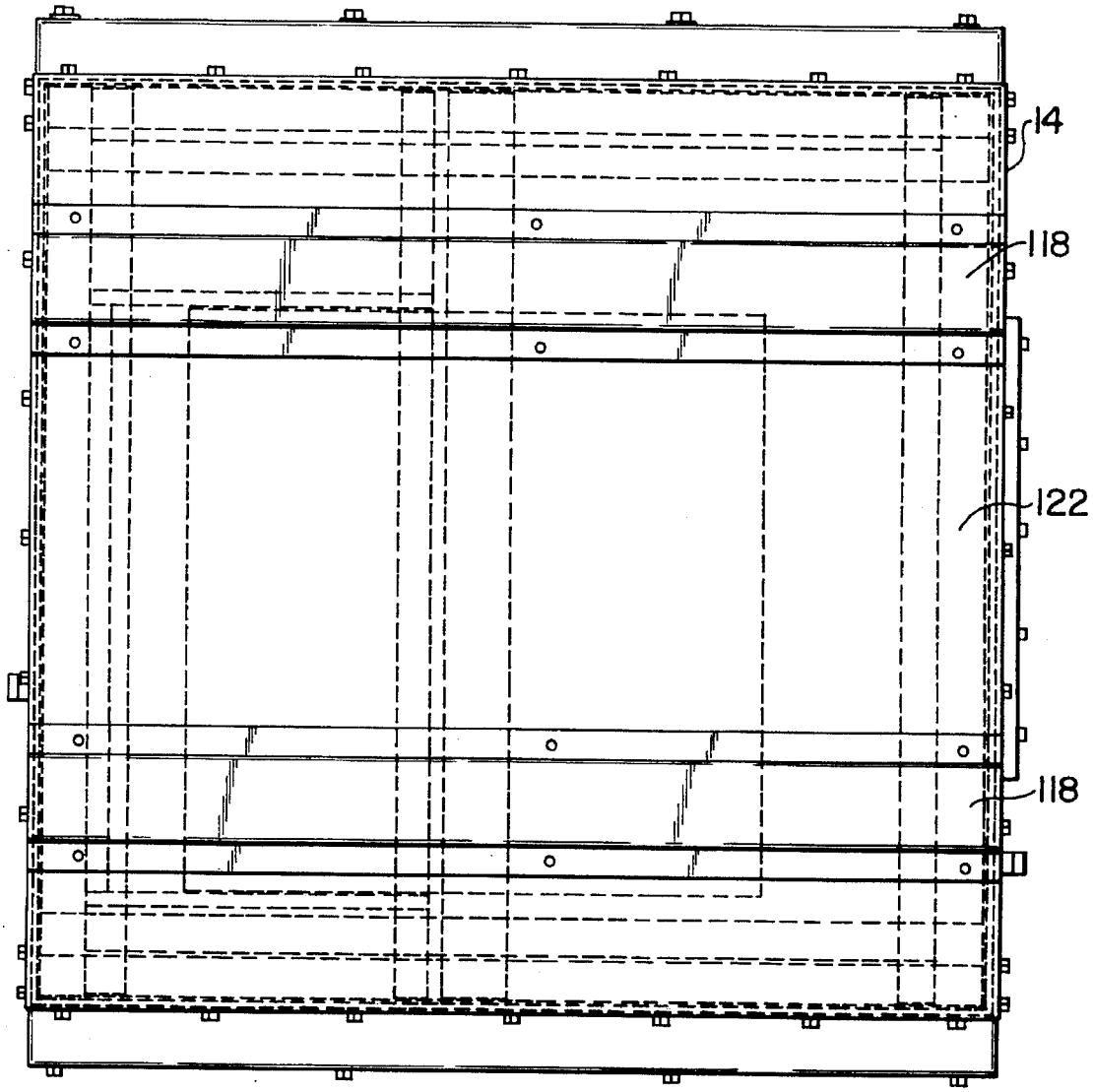
FIG. 12 is a top plan view, partially in phantom, of an air handling unit.
Figure 13:
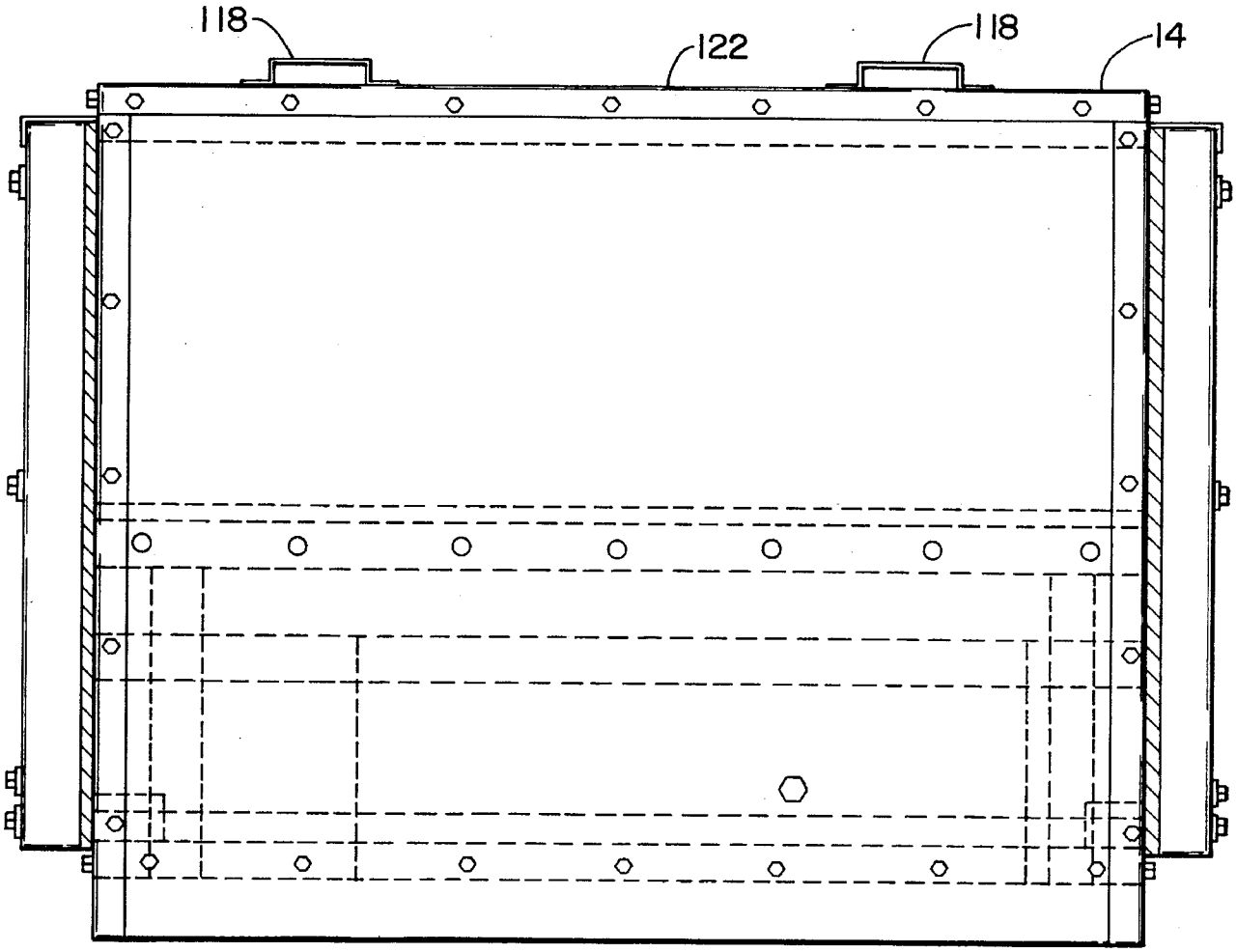
FIG. 13 is a side elevation, partially in phantom.

The evaporator fan 24 can also be provided on a removable evaporator fan deck 78, which preferably is slidably mounted on suitable supports 82 (FIGS. 2–4). The electrical control box 50 can be included on the evaporator fan deck 78 (FIGS. 7–9). An opening 84 is provided in the base of the evaporator fan deck 78, in communication with the outlet of the evaporator fan 24, to permit the exhaust of air to the supply ducts. The evaporator fan deck 78 with evaporator fan 24 and electrical control box 50 can be reversed in orientation within the air handling unit housing 14, depending on the installation location of the air handling unit 10, to aid in access to and servicing of the components.

The housing 14 (FIGS. 10–13) can be constructed with suitable material components, for example, galvanized sheet metal panels secured by screws 88. A layer of insulation 90 can be provided within the housing 14. A center member 94 can be provided to divide the housing 14 into an evaporator coil section and an evaporator fan section, and will also provide a surface on which to connect the various support flanges 62, 82. The base 96 of the housing 14 includes openings for connection to the supply/return air ducts. An opening 98 is provided for mating to the supply duct connection of the unit base roof cap. An opening 100 is provided for mating to the return duct connection of the unit base roof cap.

Air flowing to the air handling unit from the return ducts passes through the opening 100, through air filters, if any, and through the evaporator coils 20. The cooled air is then drawn by the suction of the evaporator fan 24, and is blown through the heater compartment 102 and then through th opening 98 to the supply ducts of the building. A heater assembly 104 can be provided within the evaporator housing to provide heating capability, as is known in prior air conditioner constructions. Alternatively, the evaporator fan can be equipped with a sheath type heating element. The heater assembly 104 can be reversed in the air handling unit housing 14, depending on the installation location of the air handling unit 10, to aid in access to and servicing of the heater 104.

Figure 14:
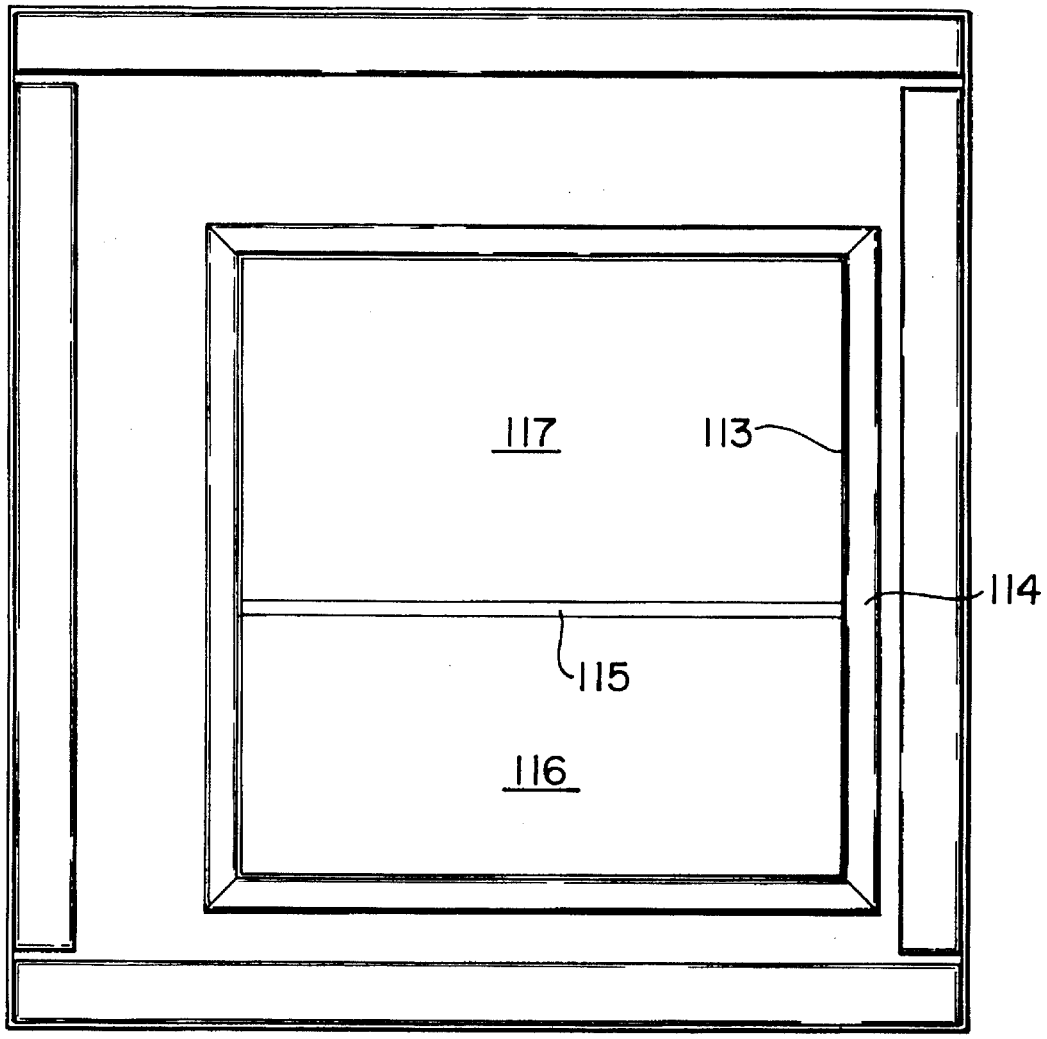
FIG. 14 is a plan view of a unit base roof jack according to the invention.
Figure 15:
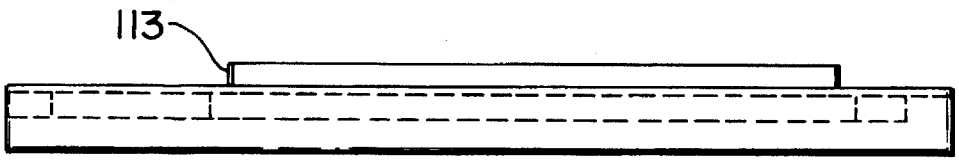
FIG. 15 is a side elevation, partially in phantom.

The air handling unit 10 can be mounted to the roof of a building according to several constructions. In a preferred construction, structure is provided for resisting water leaks into the building. Such structure can include a base flange 110 which is annular and extends about the base of the air handling unit housing 14. An upstanding flange 113 is provided on a unit base roof jack 112 (FIGS. 14–15) that is fixed to the roof of the building. The mounting flange 110 of the housing 14 fits over the upstanding flange 113 of the jack 112 to provide a secure and leak-resistant connection. A gasket 114 can be provided on the jack 112, the housing 14, or both, to further improve the leak resistance of the connection. A divider 115 separates a center opening of the jack 112 into a supply portion 116 and a return portion 117 for respective connection between the ducts and the air handling unit.

Other constructions are possible, as shown in FIGS. 19–24. The air handling unit 14 can be mounted to a roof cover 111 fitted over the roof curb. The roof cover 111 provides a platform for mounting the roof cap 112 and for mounting the condensing unit 12. The roof cap 112 fits over an upstanding flange on the roof cover 111. The depending flange of 110 of the air handling unit housing 14 fits over an upstanding flange of the roof cap 112.

The unit base roof cap can be installed in any one of four configurations to allow proper connection to the supply ducts and the return ducts of the duct system. The roof jack 112 can be lifted and repositioned as necessary. The roof jack 112 can be similarly repositioned when mounted to the roof cover. The roof jack 112 provides particular versatility in replacement work where the ducts are already installed yet accommodation must be made for a new unit, new building code requirements, or the like.

The condensing unit can be located on top of the air handling unit in some applications. This configuration is particularly desirable in replacement units for the air conditioning systems previously manufactured by Gaffers & Sattler, Inc. of Los Angeles, Calif. These units were designed for very little roof space, under 6 sq.ft. It is presently very difficult to replace these units with currently available units, which can require 12 sq.ft. of roof space. The invention provides a configuration wherein the condensing unit 12 is located on top of the air handling unit 10, and requires roof space of less than 7.5 sq.ft. The invention can replace Gaffers & Sattler, Inc.'s units in all installations. Suitable structure for mounting the condensing unit 12 onto the air handling unit 10 can be provided, such as rails 118 on the top plate 122 of the housing 14.

Figure 16:
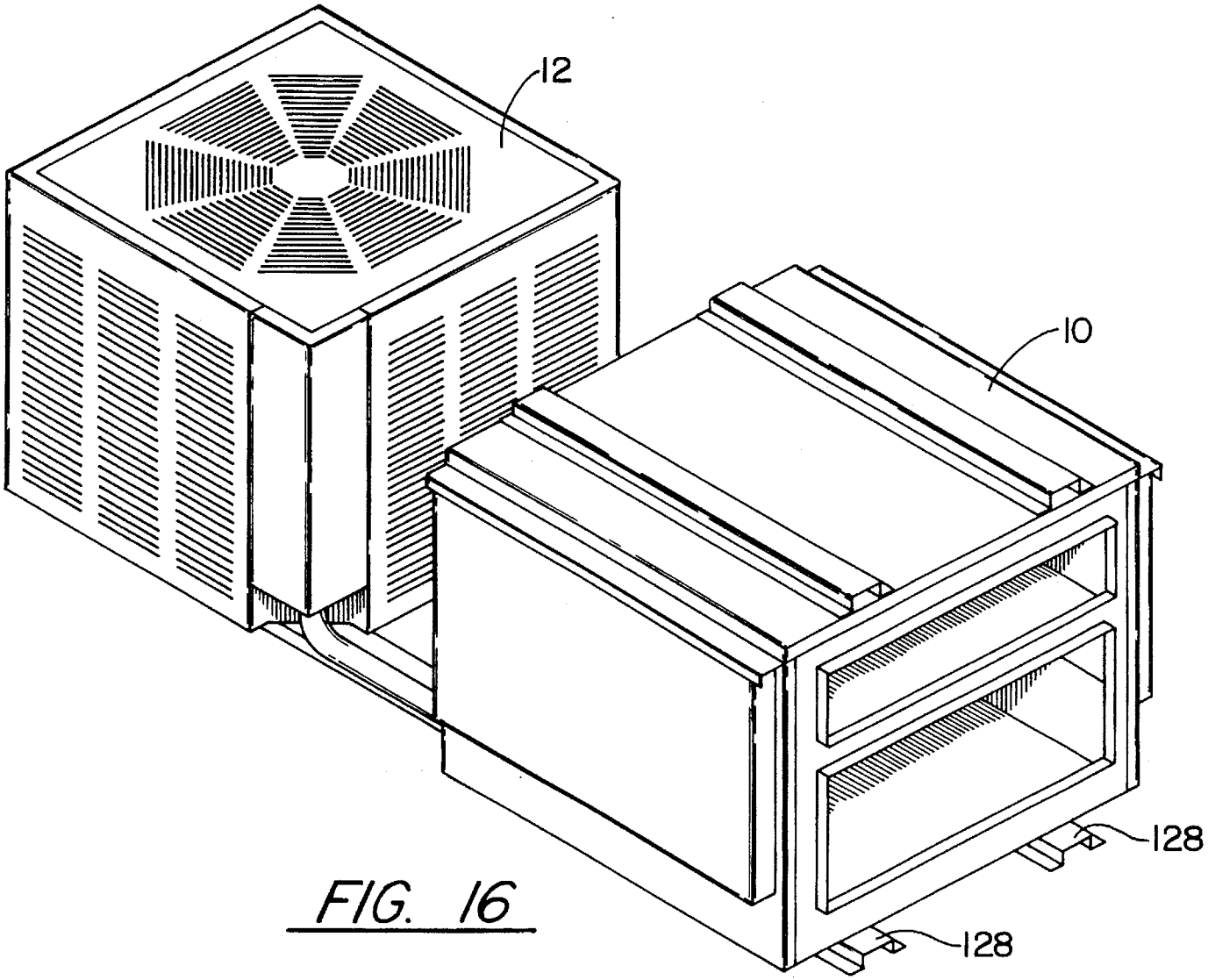
FIG. 16 is a perspective view of an alternative configuration of the invention in which a horizontal flow air handling unit has a separate condensing unit mounted adjacent thereto.

It is also possible to separately mount the condensing unit 12 remote from the air handling unit 10. In the configuration shown in FIG. 16, rails 128 or other support structure are provided on the roof. The air handling unit 10 and condensing unit 12 are separately positioned on the rails 128. The air handling unit 10 in this configuration has openings configured to the side of the housing, which are connected to the supply/return air ducts of the building by suitable connecting ducts. The connecting ducts can be enclosed within a rain shield (not shown). Alternatively, a separate connecting box can be provided with supply/return chambers for connection between the air handling unit and the roof cap.

Figure 17:
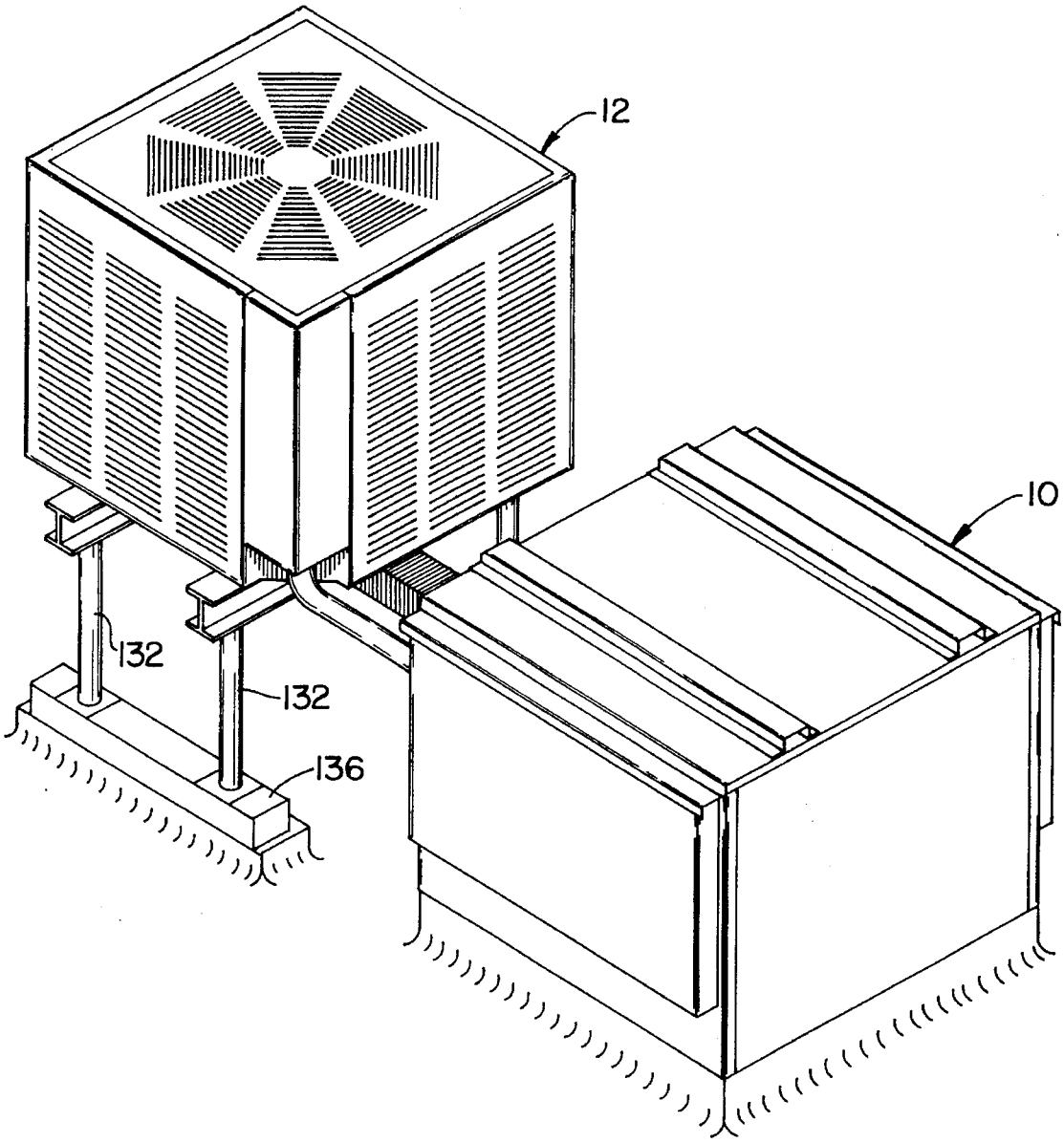
FIG. 17 is a perspective view of a second alternative configuration of the invention in which a downflow air handling unit has a separate condensing unit mounted adjacent thereto.
Figure 18:
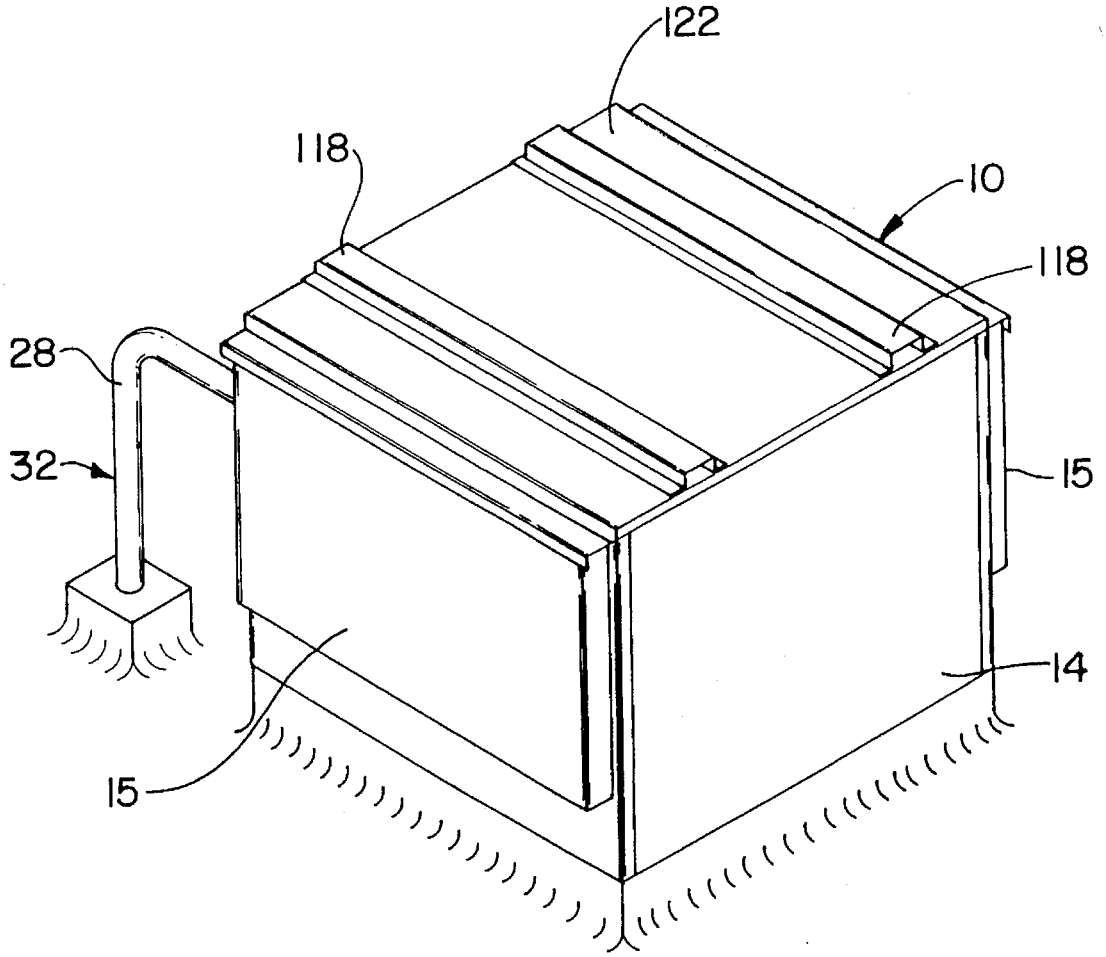
FIG. 18 is a perspective view of a third alternative configuration of a downflow air handling unit according to the invention where a separate condensing unit is mounted in a remote location.
Figure 19:
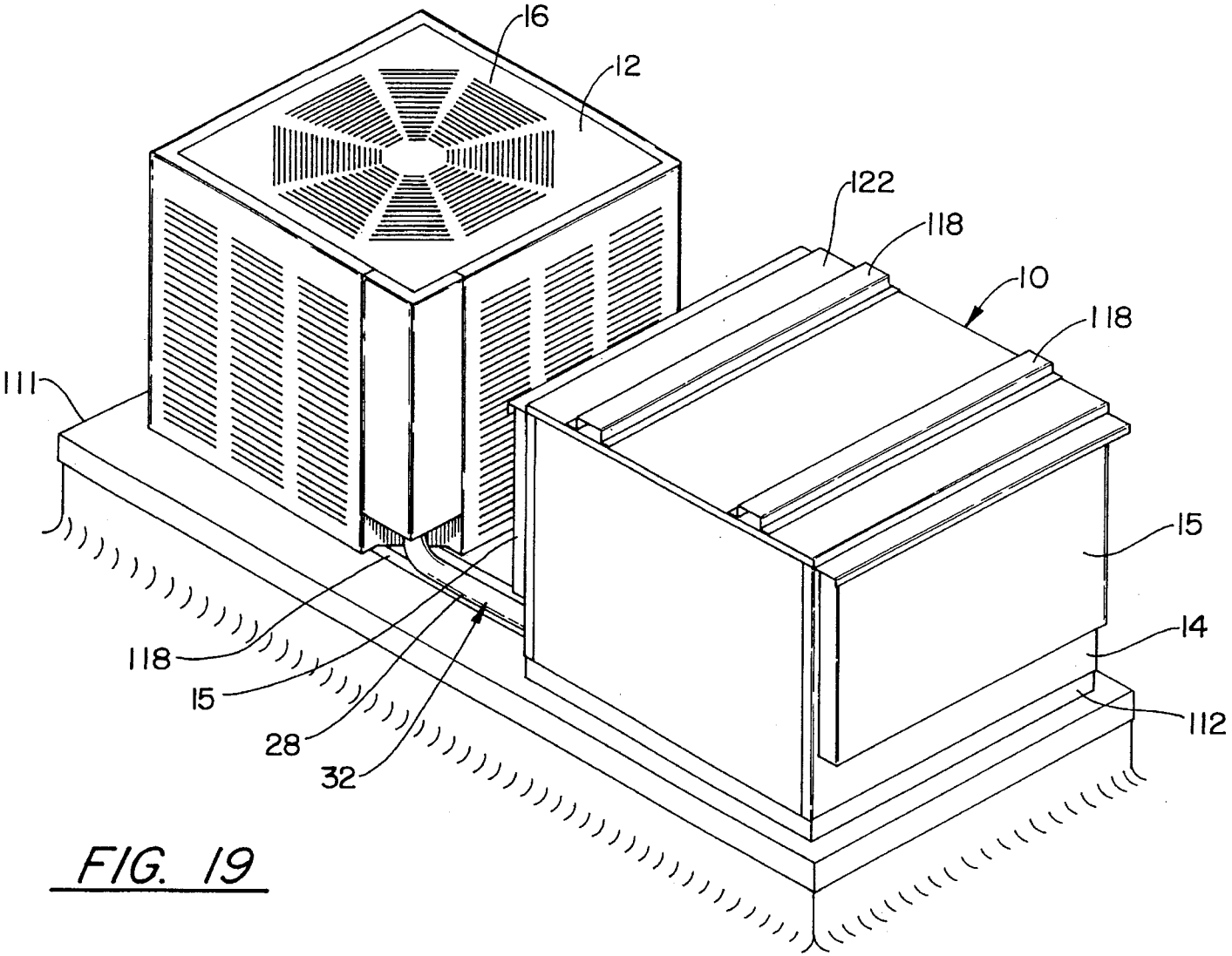
FIG. 19 is a perspective view of a fourth alternative configuration of a downflow air handling unit according to the invention, in either a left hand or right hand supply duct configuration, with a separate condensing unit mounted adjacent to the invention on a unit base roof jack.
Figure 20:
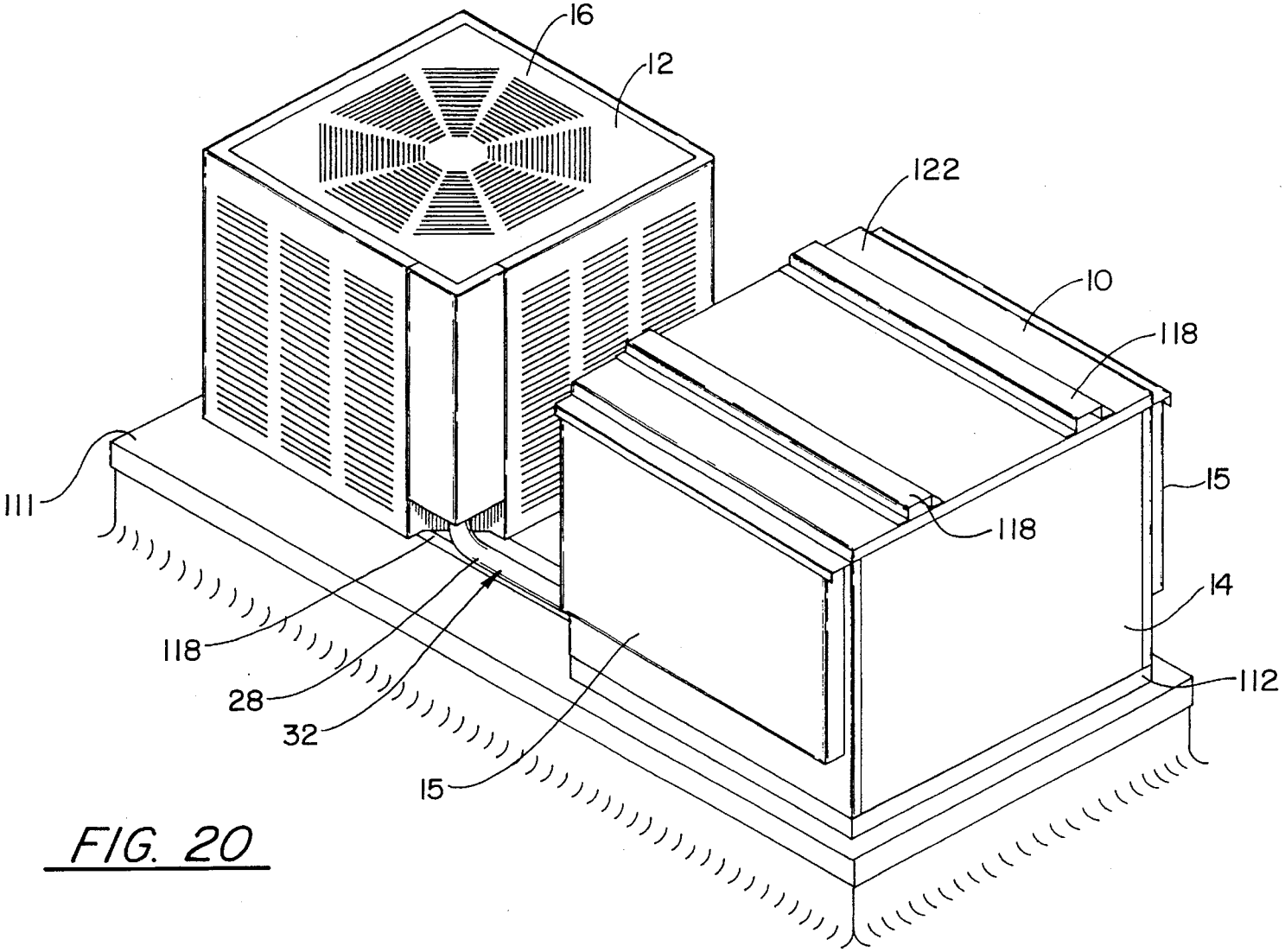
FIG. 20 is a perspective view of a fifth alternative configuration of a downflow air handling unit according to the invention, in either a top or bottom supply duct configuration, with a separate condensing unit mounted adjacent to the invention on a roof jack.
Figure 22:
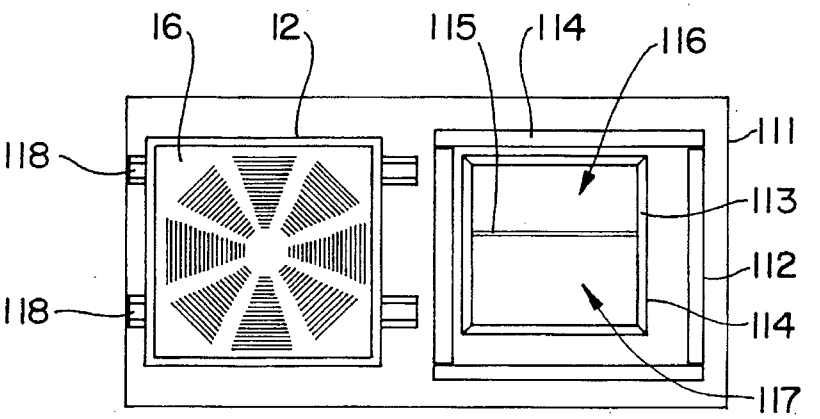
FIG. 22 is a top plan view of a unit base roof cover with a roof jack in a left hand supply duct configuration according to the invention, with separate condensing unit mounted adjacent to the invention location.
Figure 21:
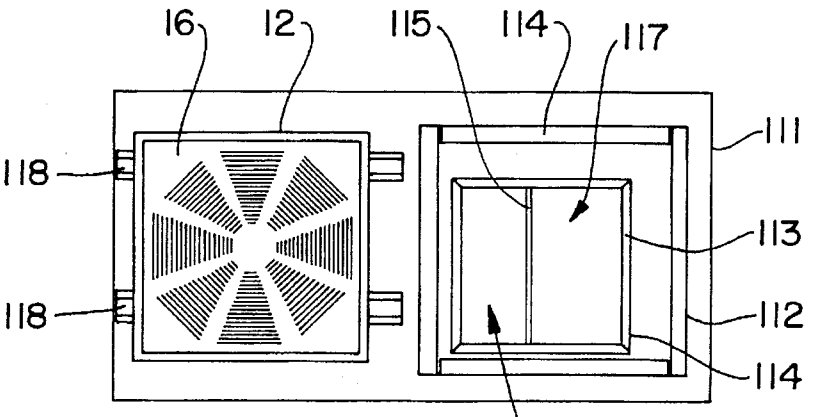
FIG. 21 is a top plan view of a unit base roof cover with a roof jack in a bottom supply duct configuration according to the invention, with a separate condensing unit mounted adjacent to the invention location.
Figure 24:
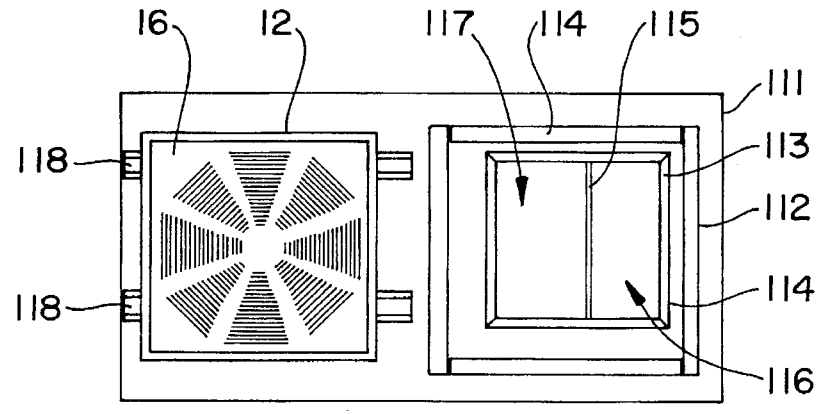
FIG. 24 is a top plan view of a unit base roof cover with a roof jack in a top supply duct configuration according to the invention, with a separate condensing unit mounted adjacent to the invention location.
Figure 23:
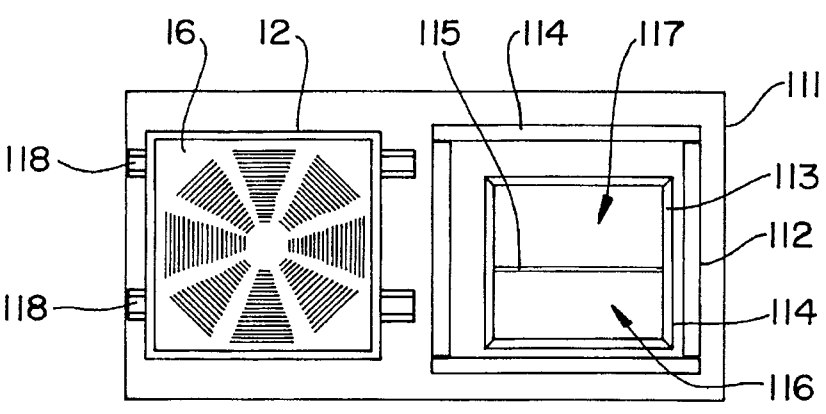
FIG. 23 is a top plan view of a unit base roof cover with a roof jack in a right hand supply duct configuration according to the invention, with a separate condensing unit mount adjacent to the invention location.

In a still additional embodiment shown in FIG. 17, the condensing unit 12 is mounted on support posts 132 which can be fixed to support brackets 136 that rest on or are fixed to the roof or another support surface. In this manner, the condensing unit will be positioned for easy service and can be located in many vertical locations.

Figure 25:
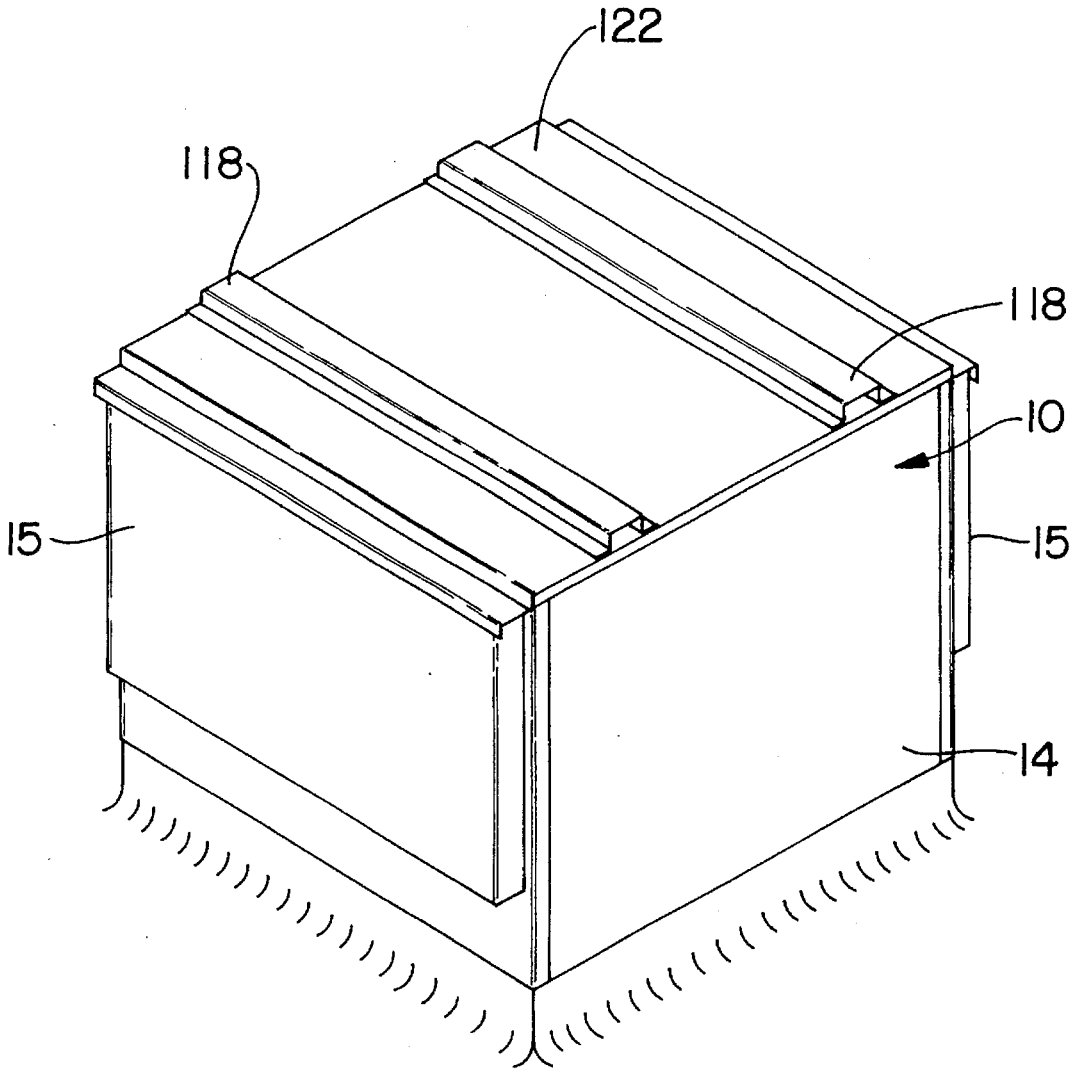
FIG. 25 is a perspective view of a downflow recirculating filtering fan according to the invention.
Figure 26:
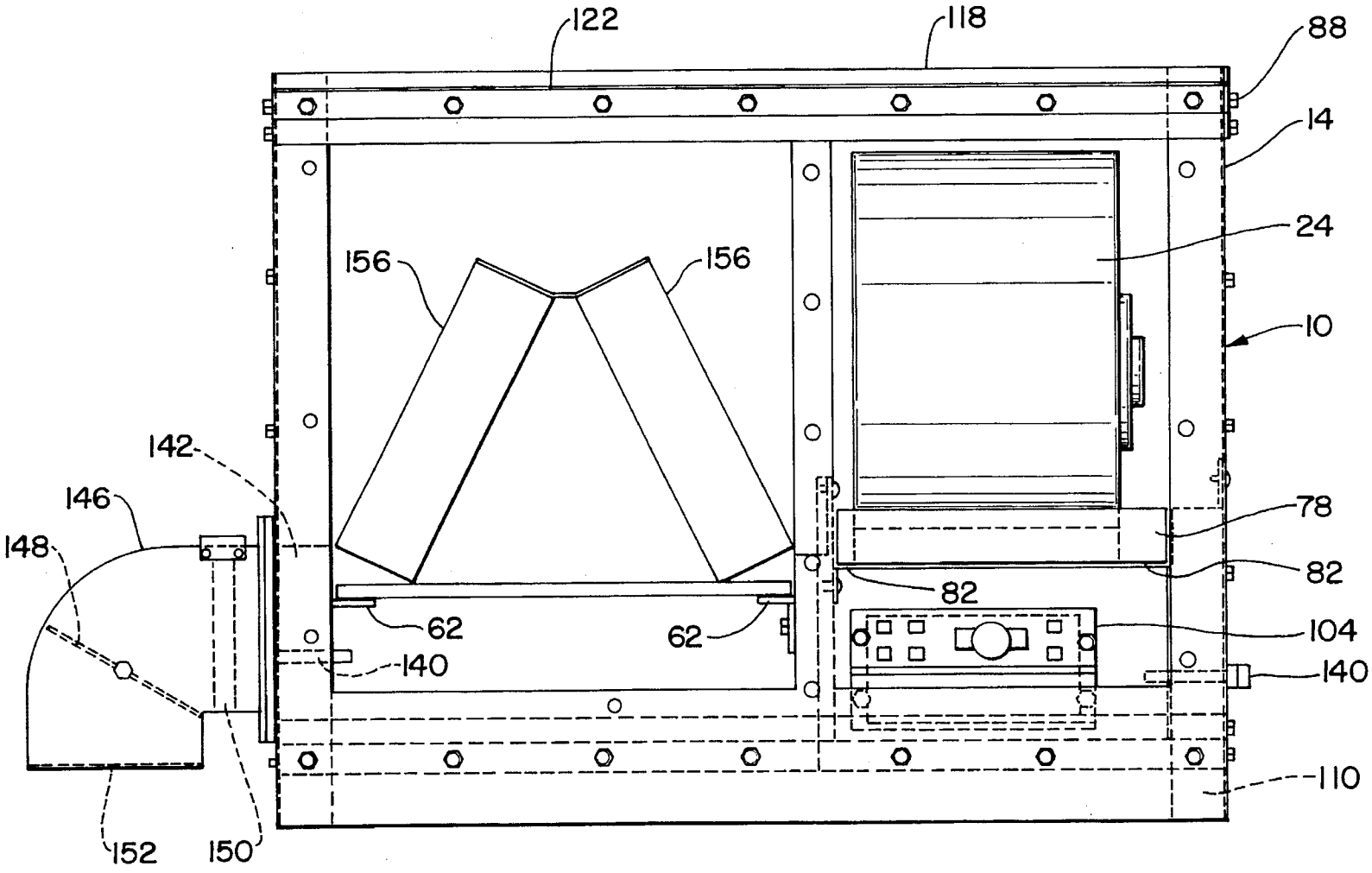
FIG. 26 is a side elevation, partially broken away and partially in phantom, of a recirculating filtering outside air fan according to the invention.

The invention can also be used as a outside air fan or a filtering recirculating fan, FIGS. 25–26, by only removing the evaporator coil 20 and coil deck 60. The air handling unit housing 14 can be fitted with high efficiency filters 156 (FIG. 26), and installed on the coil deck supports 62. This is a requirement of clean storage facilities that do not require air conditioning but do require ventilation. If heat is required on the ventilation fan (FIGS. 25–26), a heater 104 can be installed. All of the components utilized in the air conditioning air handling unit 10 of the invention are used in the ventilation fan embodiment except the evaporator coil 20 and coil deck 60 are removed.

Figure 27:
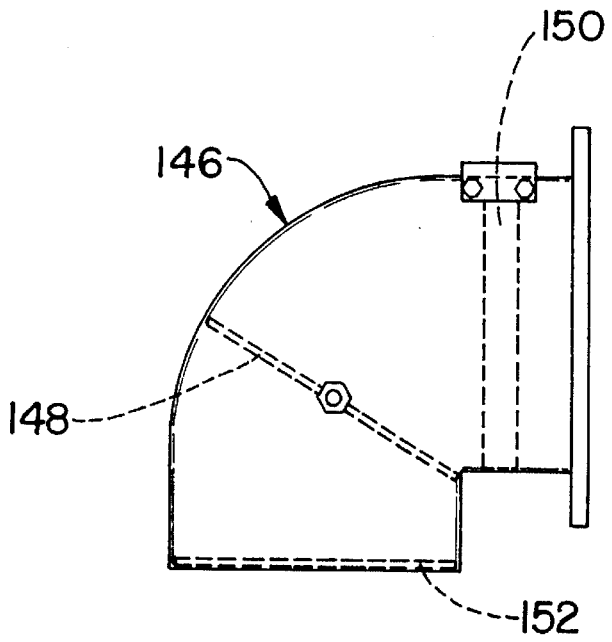
FIG. 27 is a side elevation, partially in phantom, of an outside air hood according to the invention.
Figure 28:
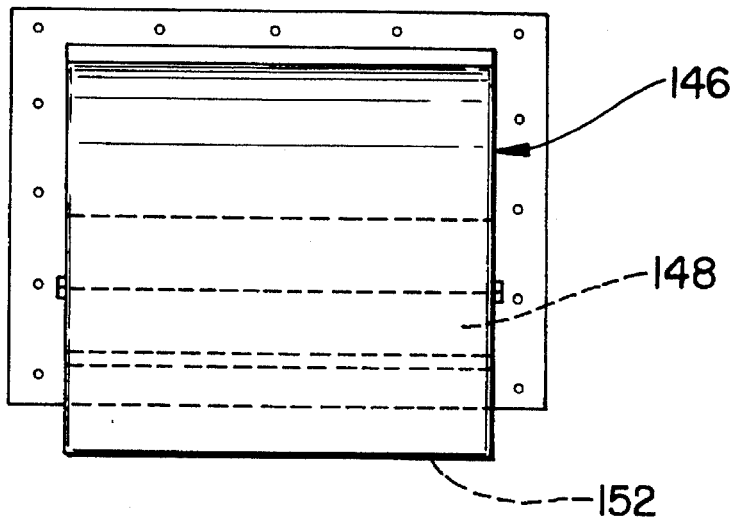
FIG. 28 is a front elevation, partially in phantom, of a outside air hood according to the invention.

The housing 14 can be fitted with weather proof fittings 140 (FIGS. 4 and 11–13) in the supply air opening 98 and the return opening 100 for measuring the air temperature and static air pressures of the system operation. This is a vital function in servicing air conditioning equipment. The housing 14 can also include an outside air opening 142 that is sealed, if not in use, with a weather tight panel 144 FIGS. 3, 4, 10–11. The outside air panel 144 can be removed and an outside air hood 146 FIG. 27–28 can be installed on the air handling unit housing 14 shown in FIG. 26. The outside air hood 146 can be fitted with an adjustable damper 148, a pre-filter 150 and a bird screen 152.

The invention, in the air conditioning mode, is capable of incorporating currently available condensing units to reach capacities of 1.5 to 5.0 nominal tons, with Energy Efficiency Ratings reaching 12.0 SEER. Higher tonnages and Energy Efficiency Ratings can also be possible and are within the scope of the invention.

The invention is capable of incorporating currently available condensing units to reach capacities of 1.5 to 5 tons, with Energy Efficiency Ratings reaching 12 EER. This invention can be embodied in specific forms other than those specifically disclosed herein without departing from the spirit or central attributes thereof, and accordingly, reference should be had to the following claims, rather than to the foregoing specification, as indicating the scope of the invention.

I claim:

1. An air conditioning system, comprising:

an air handling unit with a housing said air handling unit including structure for mounting said unit to a roof and outside of any building structure and for connecting said unit to the supply and return air ducts of a building, said air handling unit comprising an evaporator coil mounted to an evaporator coil deck, and an evaporator fan mounted an evaporator fan deck, said evaporator coil deck and said evaporator fan deck being slidably mounted within said air handling unit housing;

a condensing unit in a separate and distinct housing; and, fluid connection structure between said air handling unit and said condensing unit for transporting refrigerant therebetween.

2. The air conditioning system of claim 1, wherein said evaporator coil deck and said evaporator fan deck can be accessed by removable access panels in said air handling unit housing.

3. The air conditioning system of claim 1, wherein said evaporator coil deck and said evaporator fan deck are reversible in said air handling unit housing.

4. An air conditioning system, comprising:

an air handling unit with a housing, said air handling unit including structure for mounting said unit to a roof and outside of any building structure and for connecting said unit to the supply and return air ducts of said building;

a roof jack adapted for connection to said roof, to the supply and return air ducts of said building, and to said air handling unit;

a condensing unit in a separate and distinct housing; and, fluid connection structure between said air handling unit and said condensing unit for transporting refrigerant therebetween.

5. The air conditioning system of claim 4, wherein said roof jack comprises an upstanding mounting flange and said air handling unit comprises a depending mounting flange, said mounting flange of said housing being adapted to fit over said mounting flange of said unit based roof cover to provide a water-resistant seal.

6. The air conditioning system of claim 5, further comprising at least one gasket on at least one of said air handling unit housing and said roof jack, said gasket providing a water-resistant seal between said air handling unit housing and said roof jack.

7. A method for air conditioning a building having supply and return air ducts, comprising the steps of:

providing an air handling unit with a housing;

providing a condensing unit with a separate and distinct housing;

providing fluid connection structure for transporting refrigerant between the air handling unit and the condensing unit;

mounting the air handling unit to the roof of the building; and outside of any building structure mounting the condensing unit in a location selected from the group consisting of on top of, adjacent to, or remote from the air handling unit housing; and, connecting the refrigerant connecting lines between the air handling unit and the condensing unit.

8. A method for replacing a unitary single package air conditioning system on the roof of a building, comprising the steps of:

removing the single package air conditioning system from the roof of the building;

connecting an air handling unit with a housing to the roof of the building and outside of any building structure, and to the supply-return air ducts;

providing a condensing unit with a separate and distinct housing in a location selected from the group consisting of on top of, adjacent to, or remote from the air handling unit; and, providing refrigerant connection lines between said air handling unit and said condensing unit.

* * * * *